US012612091B2

(12) United States Patent
Gückel et al.

(10) Patent No.: US 12,612,091 B2
(45) Date of Patent: Apr. 28, 2026

(54) RAILROAD CROSSING CONTROL SYSTEM WITH AUXILIARY SHUNTING DEVICE

(71) Applicant: Siemens Mobility, Inc., New York, NY (US)

(72) Inventors: Hartmut Gückel, Peine (DE); Holger Schmidt, St. Johns, FL (US); Richard Bamfield, Ruby Bay (NZ)

(73) Assignee: Siemens Mobility, Inc., New York, NY (US)

( * ) Notice: Subject to any disclaimer, the term of this patent is extended or adjusted under 35 U.S.C. 154(b) by 568 days.

(21) Appl. No.: 18/043,661

(22) PCT Filed: Nov. 4, 2020

(86) PCT No.: PCT/US2020/058773
§ 371 (c)(1),
(2) Date: Mar. 1, 2023

(87) PCT Pub. No.: WO2022/098346
PCT Pub. Date: May 12, 2022

(65) Prior Publication Data
US 2023/0264726 A1 Aug. 24, 2023

(51) Int. Cl.
*B61L 29/22* (2006.01)
*B61L 29/28* (2006.01)

(52) U.S. Cl.
CPC ..... *B61L 29/226* (2013.01); *B61L 29/286* (2013.01)

(58) Field of Classification Search
CPC ..... B61L 29/226; B61L 29/286
See application file for complete search history.

(56) References Cited

U.S. PATENT DOCUMENTS

2006/0060724 A1 3/2006 Francis
2014/0319286 A1* 10/2014 Hogan ..... B61L 1/187 246/122 R
2015/0192636 A1 7/2015 Fries et al.
2020/0017134 A1 1/2020 Harp et al.

FOREIGN PATENT DOCUMENTS

DE 102015211141 A1 12/2016
JP 2007223465 A 9/2007

* cited by examiner

*Primary Examiner* — Robert J McCarry, Jr.

(57) ABSTRACT

A grade crossing control system (400, 600) includes a track circuit with a grade crossing predictor (GCP) system (40), and at least one auxiliary shunting device (420, 430) connected to the rails (20*a*, 20*b*) of the railroad track (20), wherein a railroad vehicle travelling on the railroad track (20) causes a change of impedance when entering the track circuit, wherein the at least one auxiliary shunting device (420, 430) detects a presence of the railroad vehicle travelling on the railroad track (20) and generates an auxiliary change of the impedance of the track circuit, and wherein the GCP system (40) generates grade crossing activation signals in response to the change of the impedance or the auxiliary change of the impedance of the track circuit. The auxiliary shunting device is provided to improve reliability in case of poor shunting. In a first implementation the auxiliary shunting device is an additional shunt (428) between rails and within the approaching distance (AL), wherein the shunt is switched on by a separate vehicle detector (422). In a second implementation the termination shunt (SI) is switched off by a vehicle detector (422) before the approaching distance (AL).

14 Claims, 6 Drawing Sheets

RAILROAD CROSSING CONTROL SYSTEM WITH AUXILIARY SHUNTING DEVICE

BACKGROUND

1. Field

Aspects of the present disclosure generally relate to railroad crossing control systems including railroad signal control equipment comprising for example a grade crossing predictor system and an auxiliary shunting device.

2. Description of the Related Art

Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are typically configured to activate the crossing warning device(s) at a fixed time, also referred to as warning time (WT), which can be for example 30 seconds, prior to the approaching train arriving at the crossing.

Typical constant warning time devices include a transmitter that transmits a signal over a circuit, herein referred to as track circuit, formed by the track's rails, for example electric current in the rails, and one or more termination shunts positioned at desired approach distances, also referred to as approach lengths, from the transmitter, a receiver that detects one or more resulting signal characteristics, and a logic circuit such as a microprocessor or hardwired logic that detects the presence of a train and determines its speed and distance from the crossing. The approach length depends on the maximum allowable speed (MAS) of a train, the desired WT, and a safety factor.

Termination shunts are mechanical devices connected between rails of a railroad track arranged at predetermined positions corresponding to the approach length required for a specific WT for the GCP system. Existing termination shunt devices may be secured onto the rails by clamp-type devices. When a railroad vehicle, e.g. train, travels along a railroad track, crosses a termination shunt and enters the track circuit, the train's axles and/or wheels act as shunts and the signal of the rails, for example electric current in the rails, is short circuited. This feature or function of a train is herein referred to as shunting. Shunting provides a means of detecting the presence of the train and ultimately calculating speed and distance of the train from the railroad crossing. However, the action of the wheels/axles of the train on the rails needs to be a reliable electrical contact. For example, if the wheels run over any insulating matter, such as for example leaves or debris on the rails, the train may not be shunting properly. Further, dirty or rusty rails may prevent proper shunting of the train. Furthermore, modern and light train set may not shunt properly, for example because of their specific vehicle design factors such as light weight (due to modern lightweight material), wheelbase, axles per car, speed etc. For example, vehicle weight, number of wheel/axel combinations, rolling resistance and type of brake are highly influential factors regarding shunting sensitivity.

SUMMARY

Briefly described, aspects of the present disclosure relate to railroad crossing control systems including railroad signal control equipment comprising for example a grade crossing predictor (GCP) system and an auxiliary shunting device.

An aspect of the present disclosure provides a grade crossing control system comprising a track circuit comprising a grade crossing predictor (GCP) system, and at least one auxiliary shunting device connected to the rails of the railroad track, wherein a railroad vehicle travelling on the railroad track causes a change of impedance when entering the track circuit, wherein the at least one auxiliary shunting device detects a presence of the railroad vehicle travelling on the railroad track and generates an auxiliary change of the impedance of the track circuit, and wherein the GCP system generates grade crossing activation signals in response to the change of the impedance or the auxiliary change of the impedance of the track circuit.

DETAILED DESCRIPTION

To facilitate an understanding of embodiments, principles, and features of the present disclosure, they are explained hereinafter with reference to implementation in illustrative embodiments. In particular, they are described in the context of being a railroad crossing control system including auxiliary shunting devices. Embodiments of the present disclosure, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
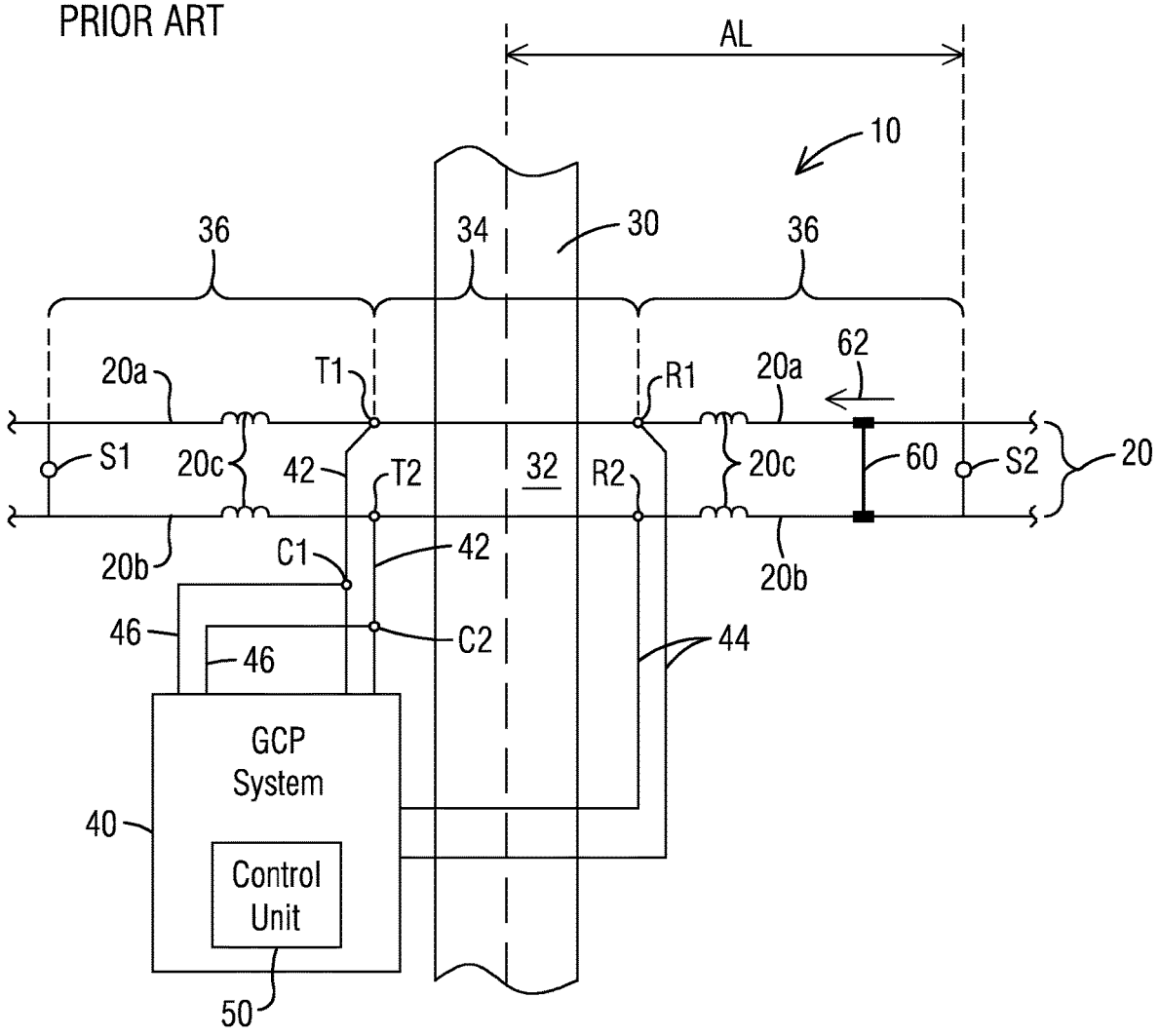
FIG. 1 PRIOR ART
FIG. 1 illustrates an example of a known railroad crossing control system in accordance with an embodiment disclosed herein.

FIG. 1 illustrates a known railroad crossing control system 10 in accordance with a disclosed embodiment. Road 30 crosses a railroad track 20. The crossing of the road 30 and the railroad track 20 forms an island 32. The railroad track 20 includes two rails 20*a*, 20*b* and a plurality of ties (not shown) that are provided over and within railroad ballast (not shown) to support the rails 20*a*, 20*b*. The rails 20*a*, 20*b* are shown as including inductors 20*c*. The inductors 20*c*, however, are not separate physical devices but rather are shown to illustrate the inherent distributed inductance of the rails 20*a*, 20*b*.

Active protection systems for at-grade highway crossings, herein also referred to as highway crossings or simply crossings, in North and South America as well as in Australia are mainly based on so-called Predictor and Motion Sensor technology. An example for this technology is grade crossing predictor system 40, herein also referred to as GCP or GCP system 40, which comprises a transmitter that connects to the rails 20*a*, 20*b* at transmitter connection points T1, T2 on one side of the road 30 via transmitter wires 42. The GCP system 40 also comprises a main receiver that connects to the rails 20*a*, 20*b* at main receiver connection points R1, R2 on the other side of the road 30 via receiver wires 44. The receiver wires 44 are also referred to as main channel receiver wires. The GCP system 40 may further comprise a check receiver that connects to the rails 20*a*, 20*b* at check receiver connection points C1, C2 via check channel receiver wires 46. The check channel receiver wires 46 are connected to the track 20 on the same side of the road 30 as the transmitter wires 42, resulting in a six-wire system. However, it should be noted that the check channel receiver wires 46 are optional, and many GCP systems operate as four-wire system.

The GCP system 40 includes a control unit 50 connected to the transmitter and receivers. The control unit 50 includes logic, which may be implemented in hardware, software, or a combination thereof, for calculating train speed, distance and direction, and producing activation signals for warning devices of the railroad crossing system 10. The control unit 50 can be for example integrated into a central processing unit (CPU) module of the GCP system 40 or can be separate unit within the GCP system 40 embodied as a processing unit such as for example a microprocessor.

Also shown in FIG. 1 is a pair of track circuit termination shunts S1, S2, herein also simply referred to as termination shunts S1, S2, one on each side of the island 32/road 30 at a desired distance from the center of the island 32. It should be appreciated that FIG. 1 is not drawn to scale and that both shunts S1, S2 are approximately the same distance away from the center of the island 32. The termination shunts S1, S2, are arranged at predetermined positions corresponding to an approach length AL required for a specific maximum authorized train speed and warning time (WT) for the GCP system 40. For example, if a total WT of 35 seconds (which includes 30 seconds of WT and 5 seconds of reaction time of the GCP system 40) at 60 mph maximum authorized speed (MAS) of a train is required, a calculated approach length AL is approximately 3900 feet (1200 m). Thus, the shunts S1, S2 are arranged each at 3900 feet from the center of the island 32. It should be noted that one of ordinary skill in the art is familiar with calculating the approach length AL. The termination shunts S1, S2 can be embodied for example as narrow band shunts (NBS).

Typically, the termination shunts S1, S2 positioned on both sides of the road 30 and the associated GCP system 40 are tuned to a same frequency. This way, the transmitter can continuously transmit one AC signal having one frequency, the receiver can measure the voltage response of the rails 20*a*, 20*b* and the control unit 50 can make impedance and constant warning time determinations based on the one specific frequency.

FIG. 1 further illustrates an exemplary axle 60 (with wheels) of a train within the track circuit. When the train, specifically the axle 60, crosses one of the termination shunts S1, S2, the train's wheels and axle(s) 60 act as shunts, which lower the impedance, as long as the train moves in the direction of the island 32 (illustrated by arrow 62), and voltage is measured by the corresponding control unit 50. Measuring the value of the impedance indicates the distance of the train and measuring the rate of change of the impedance allows the speed of the train to be determined. FIG. 1 further illustrates an island circuit 34 which is the area between transmitter connection points T1, T2 and main receiver connection points R1, R2. For example, the GCP system 40 monitors the island circuit 34 as well as approach circuits 36 which lie to the right and left of the island circuit 34, i.e., between the island circuit 34 and the termination shunts S1, S2.

It should be noted that the term GCP system as used herein refers to many types or components of railroad control equipment suitable for controlling railroad/grade crossings and/or generating railroad/grade crossing activation signals. For example, the GCP system 40 can be configured to include predictor and motion sensor technology or can be configured to only include motion sensor technology. Further, the GCP system 40 can be configured as a type of constant warning time device. The GCP system 40 as used herein presents only an example of a system for generating railroad/grade crossing activation signals.

Figure 2:
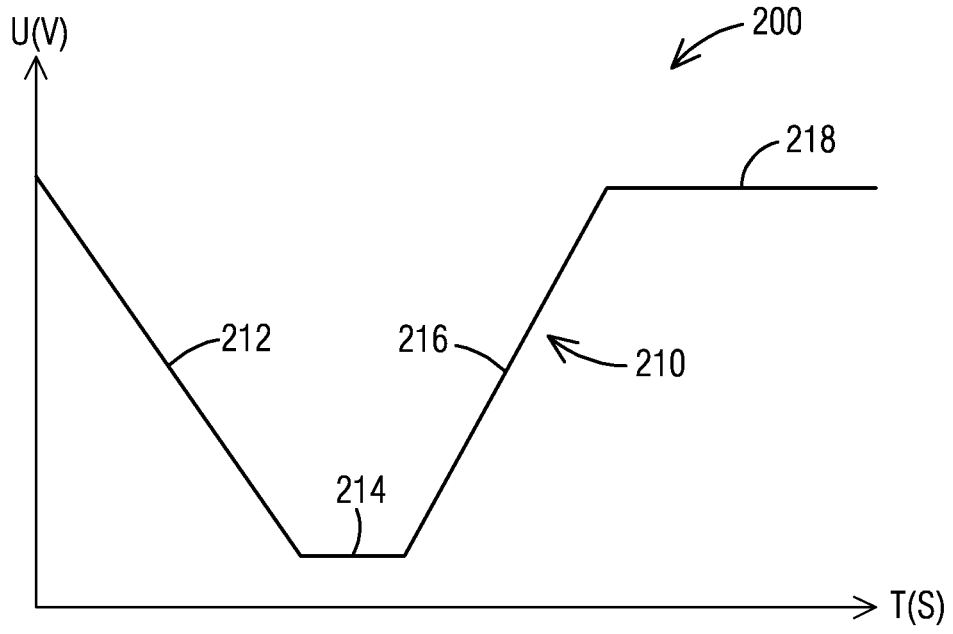
FIG. 2 illustrates a diagram of track circuit resistance of a railroad vehicle, herein also referred to as train, with proper shunting during passing of a grade crossing in connection with a known railroad crossing control system in accordance with an embodiment disclosed herein.

FIG. 2 illustrates a diagram 200 of track circuit resistance of a railroad vehicle, herein also referred to as train, with proper shunting during passing of a grade crossing in connection with a known railroad crossing control system in accordance with an embodiment disclosed herein. Diagram 200 illustrates a normal course or run 210 of track circuit resistance. The x-axis illustrates time T [S] and the y-axis illustrates voltage U [V].

As described before, the termination shunts S1, S2 and the associated GCP system 40 are preprogrammed to a same frequency. Thus, the transmitter can continuously transmit one AC signal having one frequency, the receiver can measure the voltage response of the rails 20*a*, 20*b* and the control unit 50 can make impedance and constant warning time determinations based on the one specific frequency.

A first section 212 of the normal run 210 shows a decreasing voltage (impedance) after a train has crossed the termination shunt S1. Second section 214 shows when the train passes the island 32 (island circuit 34) of the railroad crossing with the lowest voltage. After passing the island 32, the voltage U increases, see section 216, until the train crosses the termination shunt S2 on the other side of the island 32. Section 218 shows the voltage across the rails after the train has passed the crossing.

Figure 3:
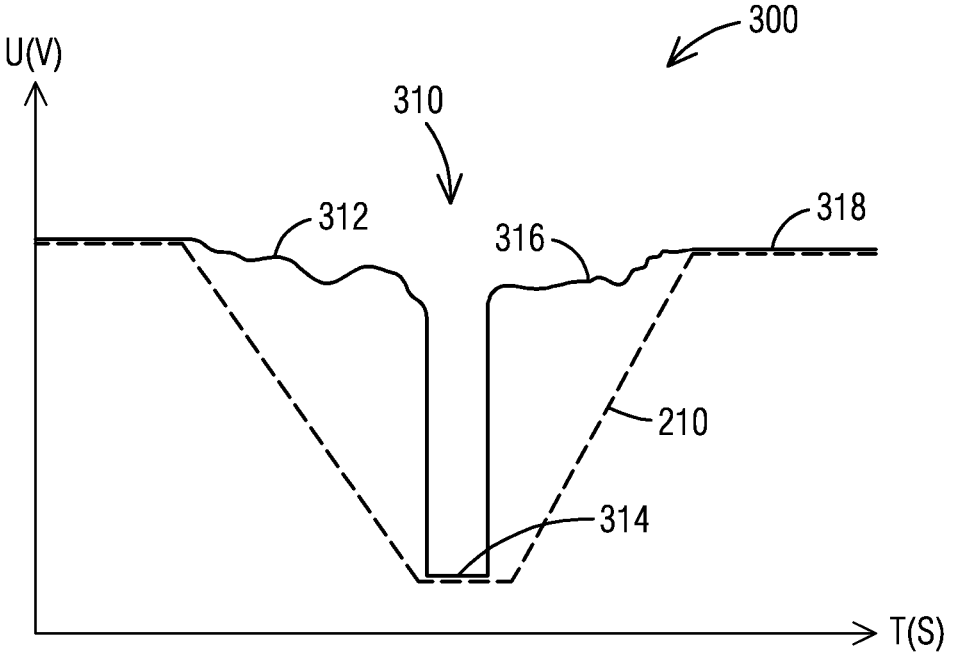
FIG. 3 illustrates a diagram of track circuit resistance of a railroad vehicle with poor shunting during passing of a grade crossing in connection with a known railroad crossing control system in accordance with an embodiment disclosed herein.

FIG. 3 illustrates a diagram 300 of track circuit resistance of a railway vehicle with poor shunting during passing of a grade crossing in connection with a known railroad crossing control system in accordance with an embodiment disclosed herein. In diagram 300, the x-axis illustrates time T [S] and the y-axis illustrates voltage U [V].

In comparison to the normal run 210 of FIG. 2, see run 210 in dotted lines in FIG. 3, diagram 300 illustrates a course or run 310 of track circuit resistance for poor shunting of the train. Instead of a decrease or increase of voltage (and thus impedance) as shown for example in FIG. 2, a decrease 312 of voltage in case of poor or insufficient shunting is irregular and unpredictable which can lead to false calculation of a speed of the train and thus false calculation of warning time signals. Section 314 shows the train passing the island 32, wherein the vertical drop in signal represents in an exemplary manner where the train starts shunting properly, but it may not do so. Section 316 illustrates the increase of voltage when the train has passed the island 32 and eventually crosses the other termination shunt S2. Again, the voltage/impedance increase is irregular and unpredictable. Section 318 shows the voltage across the rails after the train has passed the crossing.

Figure 4:
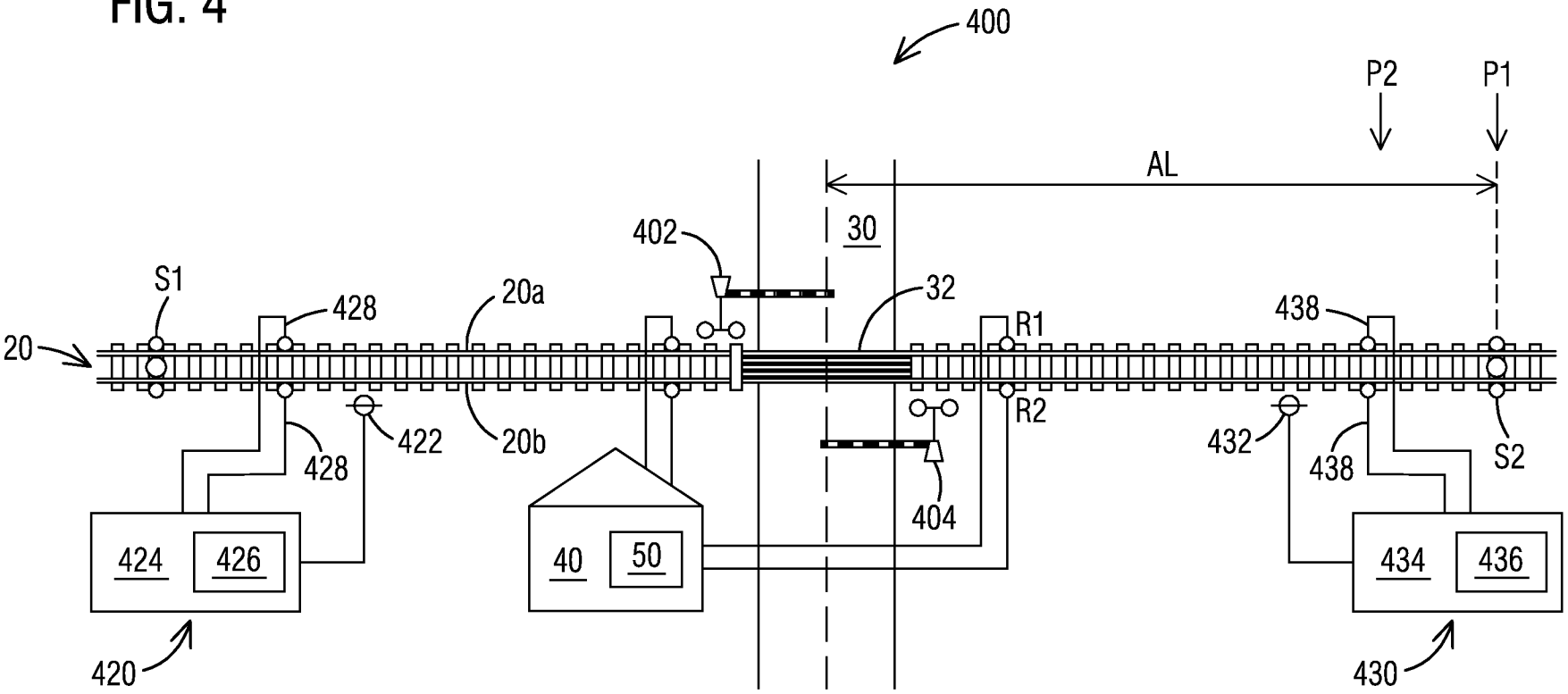
FIG. 4 illustrates a first embodiment of a railroad crossing control system including a grade crossing predictor system and an auxiliary shunting device in accordance with an exemplary embodiment of the present disclosure.

FIG. 4 illustrates a first embodiment of a railroad crossing control system 400 including a GCP system and auxiliary shunting devices in accordance with an exemplary embodiment of the present disclosure.

As noted, a quality of the axle shunt by a train is important for the overall safety of the highway crossing protection system. Poor shunting of a train could lead to a situation in which a railroad crossing, also referred to as highway crossing, remains open or might be closing too late when the train arrives (activation failure). A study of the Federal Railroad Administration (FRA) of the US Department of Transportation from December 2019 shows that the expected overall reliability target (safety target) for the activation function has clearly been missed in the past. This was caused mainly by reasons outside the actual GCP system (e.g. rail conditions).

In order to avoid activation failure of a highway crossing due to irregular and unpredictable track circuit resistance of a railroad vehicle with poor shunting, improved railroad crossing control systems including auxiliary shunting devices are provided and described herein.

In accordance with an exemplary embodiment of the present disclosure, a first embodiment of a railroad crossing control system 400 comprises a GCP system 40 with a control unit 50 configured to produce signals for warning devices 402, 404. Further, system 400 comprises track circuit termination shunts S1, S2 connected to rails 20*a*, 20*b* of a railroad track 20 at a first position P1 and auxiliary shunting devices 420, 430 connected to the rails 20*a*, 20*b* of the railroad track 20 at a second position P2.

The track circuit termination shunts S1, S2 are each arranged on opposite sides of island 32. Further, the auxiliary shunting devices 420, 430 are each arranged on opposite sides of the island 32. In another embodiment, the railroad crossing control system 400 may comprise a GCP track circuit only on one side of the island 32. In this scenario, only one termination shunt S1 or S2 and one auxiliary shunting device 420 or 430, respectively, are installed. Such a one side installation is important for unidirectional traffic or alternative activation devices on the opposite site of the island.

The auxiliary shunting devices 420, 430 are configured for operation in combination with the GCP system 40. Specifically, the auxiliary shunting devices 420, 430 are configured to support poor or insufficient shunting of a train.

The proposed and described system 400 with auxiliary shunting devices 420, 430, provide support of the train detection function of the GCP system 40 without changing or influencing a predictor analysis for normal or proper shunting trains. Triggered by a diverse redundant sensor system, e.g. a wheel sensor, an auxiliary shunt between the rails applied and detected via the track circuit for trains with poor shunting. The GCP system 40 (or other type of Predictor and Motion sensor technology) is configured to detect the additional signal and to react with an auxiliary activation of the crossing warning system, e.g. warning devices 402, 404.

As noted, the track circuit termination shunts S1, S2 are positioned in accordance with a calculated approach length AL required for activation of the crossing warning devices 402, 404. The first (predefined) position P1 of the termination shunts S1, S2 corresponds to the approach length AL.

As FIG. 4 illustrates, the auxiliary shunting devices 420, 430 are located within an approach section of the approach length AL of the termination shunts S1, S2, i.e. between the island 32 and the termination shunts S1, S2. Thus, the second position P2 of the auxiliary shunting devices 420, 430 is closer to the island 32 or, in other words, a distance between the center of the island 32 and an auxiliary shunting device 420, 430 is less or smaller than the approach length AL.

A distance for the auxiliary shunting device 420, 430 from the respective termination shunt S1, S2 is such that a proper axle shunt of a train causes a detectable drop of the track circuit impedance (voltage). A distance for the auxiliary shunting device 420, 430 from the center of the island 32 is calculated or chosen such that an activation of the auxiliary device 420, 430 occurs in time to allow proper shunting of a fastest train on the specific line, e.g., railroad track 20, (track speed/civil track speed) without causing a safety hazard for fast moving, in case of a malfunction of the proposed system.

In an embodiment, each auxiliary shunting device 420, 430 comprises a railroad vehicle detection sensor 422, 432, herein also referred to as train detection sensor 422, 432, an interface device 424, 434 connected to the train detection sensor 422, 432, and a power supply 426, 436 configured to power the auxiliary shunting device 420, 430, specifically the train detection sensors 422, 432 and the interface devices 424, 434. Further, the auxiliary shunting devices 420, 430 comprise electrical connections 428, 438, such as cables, connected to both rails 20*a*, 20*b* and to the interface device 424, 434.

Each train detection sensor 422, 432 is configured to detect a train or railroad vehicle travelling on the railroad track 20. In an embodiment, the train detections sensors 422, 432 are configured to detect wheels and/or axles of a train travelling on the railroad track 20. In other embodiments, the train detection sensors 422, 432 are configured to detect the train, for example a train car or train wagon, without detecting the wheels and/or axles. The train or railroad vehicle is detected when the train passes the train detection sensors 422, 432 or when the train is in range and detectable by the sensors 422, 432. Based on a detected train, the interface device 424, 434 triggers or performs an action. For example, when the train detection sensor 422 detects the train on the track 20, the sensor 422 provides a signal to the interface device 424 which in turn triggers or performs an action.

As soon as a train is be detected by the train detection sensor 422, 432, the interface device 424, 434 causes an electrical bypass, i.e. shunt, via the connections 428, 438 to the rails 20*a*, 20*b*. This additional electrical bypass effects the impedance of the track circuit in the same way as a proper shunt of a train axle. Thus, for trains shunting properly, the impedance signal at the GCP system 40 will not or only minimally be influenced. It will appear to the GCP system 40 like an additional perfectly shunting axle. However, in case of a poorly shunting train, this additional electrical bypass will cause a sudden change of the impedance to a normally expected level at this location. This sudden change to the known impedance level can be detected by the GCP system 40. An auxiliary activation will then be initiated.

Figure 5:
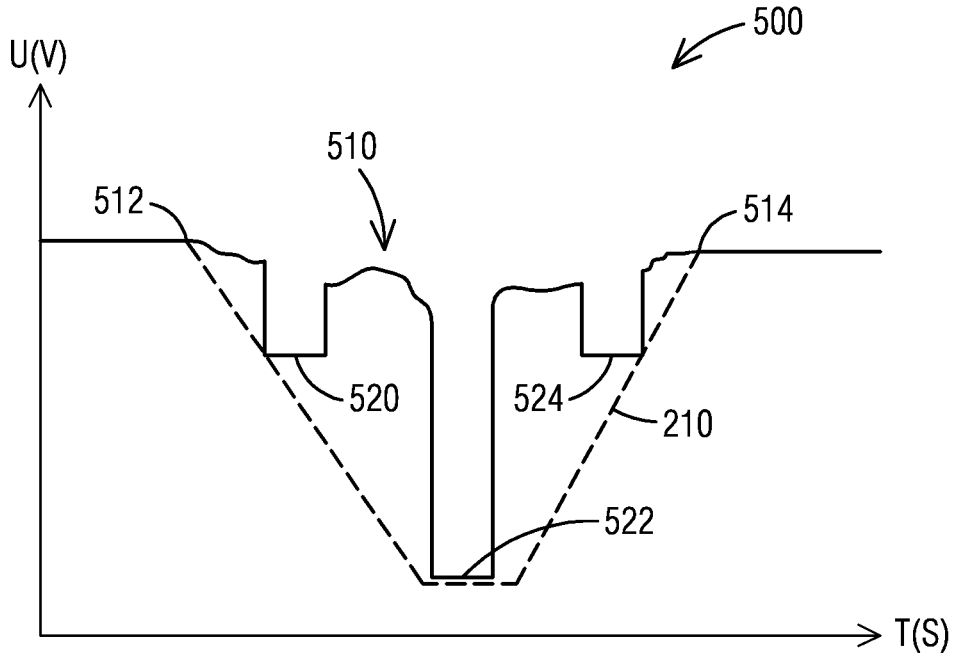
FIG. 5 illustrates a diagram of track circuit resistance of a railroad vehicle during passing of a grade crossing in connection with the first embodiment of a railroad crossing control system of FIG. 4 in accordance with an exemplary embodiment of the present disclosure.

FIG. 5 illustrates a diagram 500 of track circuit resistance of a railroad vehicle during passing of a grade crossing in connection with the first embodiment of a railroad crossing control system of FIG. 4 in accordance with an exemplary embodiment of the present disclosure. In diagram 500, the x-axis illustrates time T [S] and the y-axis illustrates voltage U [V].

In comparison to the normal run 210 of FIG. 2, see run 210 in dotted lines in FIG. 5, diagram 500 illustrates a course or run 510 of track circuit resistance for poor shunting of a train and including auxiliary shunting devices 420, 430 arranged according to the embodiment described with reference to FIG. 4. At point 512 of the course 510, the train passes the first termination shunt, for example termination shunt S1, and, due to poor shunting of the train, the voltage (impedance) decreases in an irregular and unpredictable manner. When the train passes the first auxiliary shunting device, for example auxiliary shunting device 420, the train detection sensor 422 detects the train and causes an additional shunt (electrical bypass). The additional shunt causes noticeable changes in voltage (impedance) that are recognized by the GCP system 40, see section 520, as a shunt of the train. Section 522 illustrates when the train passes the island 32/island circuit 34. After passing the island 32, the train passes the second auxiliary shunting device, for example device 430, and is detected by the respective train detection sensors 432, see section 524. Point 514 illustrates when the train passes the second termination shunt, for example shunt S2. After passing point 514, the course 510 shows the voltage across the rails after the train has passed the crossing.

Figure 6:
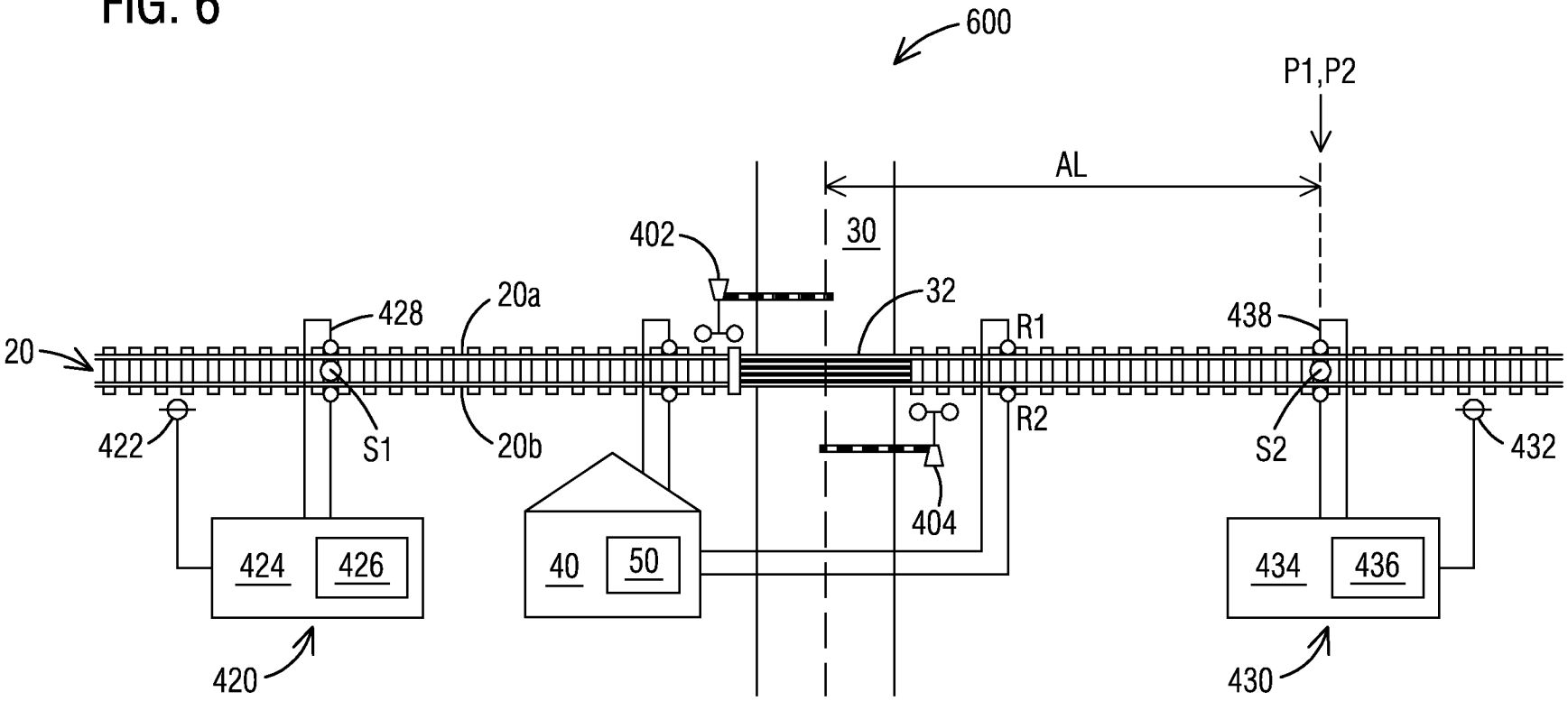
FIG. 6 illustrates a second embodiment of a railroad crossing control system including a grade crossing predictor system and an auxiliary shunting device in accordance with an exemplary embodiment of the present disclosure.

FIG. 6 illustrates a second embodiment of a railroad crossing control system 600 including a GCP system and auxiliary shunting devices in accordance with an exemplary embodiment of the present disclosure. The system 600 of FIG. 6 is similar to the system 400 of FIG. 4; however, the placement of the auxiliary shunting devices 420, 430 is different in system 600. Identical or similar components are labeled with the same reference numerals and it is referred to the description of these components with reference to FIG. 4.

As FIG. 6 illustrates, the auxiliary shunting devices 420, 430 are arranged so that the train detection sensors 422, 432 are positioned outside and ahead of the respective approach length AL. The electrical connections 428, 438 are coupled at one end to the termination shunts S1, S2 at the rails 20*a*, 20*b*, and at the other end to the interface devices 424, 434. Thus, the auxiliary shunting devices 420, 430 are electrically coupled to the termination shunts S1, S2 and are located at the same position as the termination shunts S1, S2, i.e. the approach length AL.

In an exemplary embodiment, the train detection sensor 422, 432 is installed ahead of the approach section of the approach length AL at a distance to allow sufficient time to detect a change in signal by the GCP system 40 before the train passes the location of the termination shunt S1, S2 and enters the approach track circuit section.

As soon as a train is detected by the train detection sensor 422, 432, the interface devices 424, 434 opens an electrical connection to the termination shunt S1, S2. This opening of the termination shunt S1, S2 will increase the impedance of the track circuit. The impedance increase will be distinct enough so that it can be detected by the GCP system 40 and is used as a pre-announcement trigger of the train. The GCP system 40 is configured to start a timer in response to the pre-announcement trigger. If the GCP system 40 detects a decreasing impedance of an inbound train based on the train crossing the termination shunt S1, S2 in a usual manner (train properly shunting), the GCP system 40 is configured to cancel the timer and use its normal prediction algorithms to activate the crossing. If the train is shunting poorly and the GCP system 40 is not able to detect the train motion, the timer will continue and after a pre-set time expire and the GCP system 400 will activate the crossing, e.g., generate constant warning time signal(s), in response to an expired timer.

Figure 7:
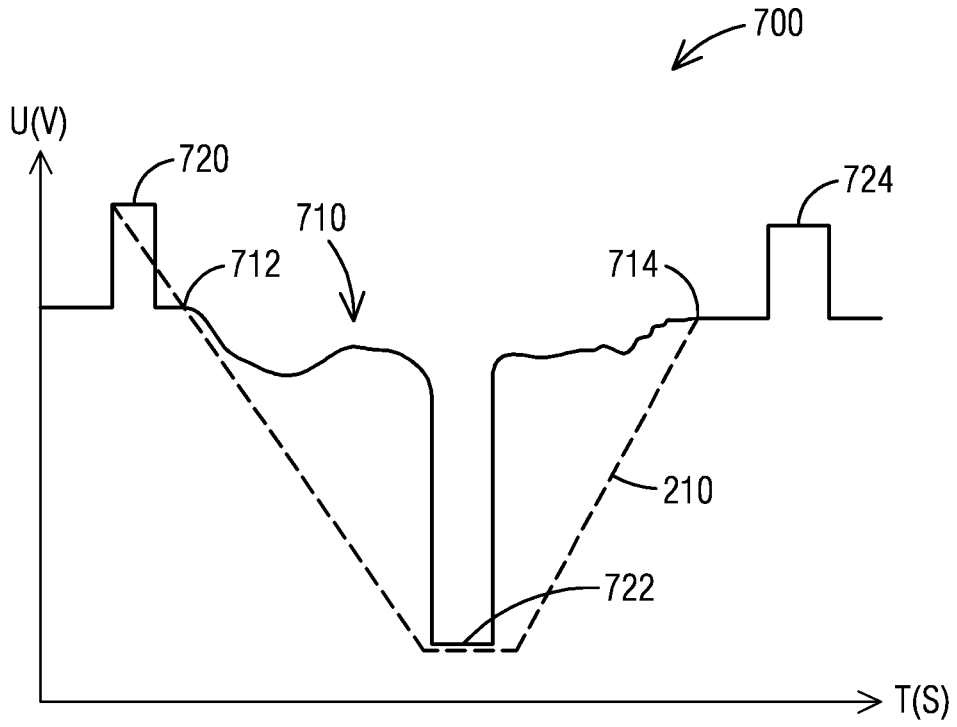
FIG. 7 illustrates a diagram of track circuit resistance of a railroad vehicle during passing of a grade crossing in connection with the second embodiment of a railroad crossing control system of FIG. 6 in accordance with an exemplary embodiment of the present disclosure.

FIG. 7 illustrates a diagram 700 of track circuit resistance of a railroad vehicle during passing of a grade crossing in connection with the second embodiment of a railroad crossing control system of FIG. 6 in accordance with an exemplary embodiment of the present disclosure. In diagram 700, the x-axis illustrates time T [S] and the y-axis illustrates voltage U [V].

In comparison to the normal run 210 of FIG. 2, see run 210 in dotted lines in FIG. 7, diagram 700 illustrates a course or run 710 of track circuit resistance for poor shunting of a train and including auxiliary shunting devices 420, 430 arranged according to the embodiment described with reference to FIG. 6. When the train passes the train detection sensor of the first auxiliary shunting device, for example sensor 422 of auxiliary shunting device 420, the train detection sensor 422 detects the train and provides a corresponding signal to the interface device 424, which in turn opens the electrical connection to the respective termination shunt S1, illustrated by section 720. The opening or disconnect of the termination shunt S1 increases the voltage (impedance) of the track circuit. The impedance increase is distinct enough so that it is detectable by the GCP system 40 and is used as a pre-announcement trigger of the train. As the train detection sensor 422 is arranged before the termination shunt S1, the train is detected by the train detection sensor 422 before the train crosses the termination shunt S1. Thus, the disconnect of the electrical connection may be prior to the train crossing the termination shunt S1 at point 712.

Section 722 illustrates when the train passes the island 32/island circuit 34. After passing the island 32, the train passes the second termination shunt, for example shunt S2, see point 714, and second auxiliary shunting device, for example device 430, and is detected by the respective train detection sensors 432, see section 724. Since the train detection sensor lies outside the approach length AL and ahead of the termination shunt S2, the increase in voltage (impedance) occurs after point 714.

Examples of the train detection sensor 422, 432 include a radar sensor, an infrared sensor, a lidar sensor, a motion sensor, and a combination thereof.

For the auxiliary shunting device 420, 430 to be able to perform the action such as cause an electrical bypass (shunt) or open an electric connection, the auxiliary shunting device 420, 430 may comprise a wheel sensor relay which is an electronic switch coupled to a rail, for example rail 20*a* and/or 20*b*, that opens or closes an electric connection at the rails 20*a*, 20*b*. The train detection sensor 422, 432 provides input to the relay, wherein a relay output is utilized for electronically and electromechanically closing (shunting) or opening the electrical connection at the rails 20*a*, 20*b*.

The GCP system 40 with control unit 50 may comprise a specific module, which can be software or a combination of software and hardware, for detecting and processing of the signal of the auxiliary shunting devices 420, 430. The specific module may be a separate module or may be an existing module programmed to perform a method as described herein. For example, the module may be incorporated, for example programmed, into an existing control unit 50 of a GCP system 40 by means of software.

The proposed railroad crossing control systems 400, 600 can be used as an add-on solution for existing Predictor or Motion Sensor systems or GCP systems of highway crossing protection systems. The systems 400, 600 do not change main function(s) of the installed system but can increase reliability and therefore overall safety of the highway crossing at locations with shunting problems or on tracks with mixed traffic (new train sets with poor shunting function).

The invention claimed is:

1. A grade crossing control system comprising:

a track circuit comprising a grade crossing predictor (GCP) system, and at least one auxiliary shunting device connected to the rails of the railroad track, wherein a railroad vehicle travelling on the railroad track causes a change of impedance when entering the track circuit, wherein the at least one auxiliary shunting device detects a presence of the railroad vehicle travelling on the railroad track and generates an auxiliary change of the impedance of the track circuit, wherein the GCP system generates grade crossing activation signals in response to the change of the impedance or the auxiliary change of the impedance of the track circuit, and further comprising at least one termination shunt, wherein a first position of the at least one termination shunt corresponds to an approach length required for activation of a crossing warning device, and wherein the at least one auxiliary shunting device is positioned within an approach section of the approach length.

2. The grade crossing control system of claim 1, wherein the interface device is configured to cause an electrical bypass to the rails in response to the detected railroad vehicle by the railroad vehicle detection sensor.

3. The grade crossing control system of claim 1, comprising multiple track circuit termination shunts and multiple auxiliary shunting devices.

4. The grade crossing control system of claim 1, wherein the at least one auxiliary shunting device comprises a relay.

5. The grade crossing control system of claim 1, wherein the at least one auxiliary shunting device further comprises a power supply configured to power the train detection sensor and the interface device, and electrical connections to the rails and/or to at least one track circuit termination shunt.

6. The grade crossing control system of claim 1, wherein the GCP system is configured to detect and process the auxiliary change of impedance of the track circuit caused by the auxiliary shunting device.

7. The grade crossing control system of claim 1, wherein the GCP system comprises predictor technology and/or motion sensor technology.

8. The grade crossing control system of claim 1, wherein the at least one auxiliary shunting device comprises a railroad vehicle detection sensor and an interface device connected to the railroad vehicle detection sensor.

9. The grade crossing control system of claim 8, wherein the railroad vehicle detection sensor is configured to detect wheels and/or axles of the railroad vehicle.

10. The grade crossing control system of claim 8, wherein the railroad vehicle detection sensor is selected from a train detection device, a radar sensor, an infrared sensor, a lidar sensor, a motion sensor, and a combination thereof.

11. The grade crossing control system of claim 8, further comprising at least one termination shunt, wherein a first position of the at least one track circuit termination shunt corresponds to an approach length required for activation of a crossing warning device, wherein the railroad vehicle detection sensor is installed outside and ahead of the approach length, and wherein the interface device of the at least one auxiliary shunting device is electrically connected to the at least one track circuit termination shunt located at the first position.

12. The grade crossing control system of claim 11, wherein the interface device is configured to disconnect from the at least one track circuit termination shunt in response to a detected railroad vehicle by the railroad vehicle detection sensor.

13. The grade crossing control system of claim 12, wherein disconnecting from to the at least one termination shunt increases the impedance, and wherein an increased impedance signal is detectable by the GCP system and triggers a timer for generating a grade crossing activation signal.

14. The grade crossing control system of claim 13, wherein the timer is cancelled when the GCP system detects a decreasing impedance of the railroad vehicle passing the at least one termination shunt.

* * * * *